US006656101B2

(12) United States Patent
Tisi

(10) Patent No.: US 6,656,101 B2
(45) Date of Patent: Dec. 2, 2003

(54) CONTAINER LINERS

(75) Inventor: Antony Luigi Paul Tisi, Benfleet (GB)

(73) Assignee: Philton Polythene Converters Limited, Canvey Island (GB)

( * ) Notice: Subject to any disclaimer, the term of this patent is extended or adjusted under 35 U.S.C. 154(b) by 16 days.

(21) Appl. No.: 10/148,605

(22) PCT Filed: Nov. 30, 2000

(86) PCT No.: PCT/GB00/04571

§ 371 (c)(1),
(2), (4) Date: May 30, 2002

(87) PCT Pub. No.: WO01/39967

PCT Pub. Date: Jun. 7, 2001

(65) Prior Publication Data

US 2002/0193221 A1 Dec. 19, 2002

(30) Foreign Application Priority Data

Dec. 4, 1999 (GB) ..... 9928640

(51) Int. Cl.[7] ..... B31B 7/00

(52) U.S. Cl. ..... 493/93; 493/189; 493/194; 493/199

(58) Field of Search ..... 493/86, 93, 186, 493/189, 84, 194, 197, 199, 374, 379; 229/123.1

(56) References Cited

U.S. PATENT DOCUMENTS 4,717,374 A * 1/1988 Elias ..... 493/292
5,857,613 A * 1/1999 Drummond et al. ..... 229/202
5,979,748 A * 11/1999 Drummond et al. ..... 229/123.1
6,190,485 B1 * 2/2001 Cahill et al. ..... 156/195
6,561,962 B1 * 5/2003 Engelhart ..... 493/199

* cited by examiner

*Primary Examiner*—Eugene Kim
(74) *Attorney, Agent, or Firm*—Renner, Kenner, Greive, Bobak, Taylor and Weber

(57) ABSTRACT

A method of and apparatus for the automated manufacture of a liner of a cargo container has a work area (35) over which tubular plastics material (15) may be drawn out, for forming the liner. A shuttle (39) is disposed between the layers (18, 19) of the material and is maintained stationary as the material is drawn out, until a portion of the liner (15) to carry an attachment is disposed over the shuttle (39). The shuttle provides a counter-force for the bonding of the attachment (23) (such as an access pipe) to the liner and also serves to hold apart the upper layer (18) of the material from the or each other layer during the bonding operation. The shuttle may have rollers (41) which run on an internal surface of the liner material and may be maintained stationary with respect to the work area by magnets (52, 53) on the work area (35) and the shuttle (39) respectively. Following the drawing of a sufficient length of material while holding the shuttle stationary, the drawn length may be welded across (FIG. 9) to form and end panel for the liner and severed from the remaining material, with the shuttle (39) disposed in the remaining material.

23 Claims, 12 Drawing Sheets

CONTAINER LINERS

This invention relates to methods of and apparatus for the manufacture of container liners. In particular, the apparatus relates to such methods and apparatus which are able to operate on at least a semi-automatic basis, with the aim of facilitating handling and product accuracy in the manufacture of such liners.

Liners for cargo containers, such as ISO box containers, are well-known and widely used for the bulk transport of flowable products—for example granular materials including agricultural produce and chemicals. Such liners are usually made from plastics sheet material which is preformed into a tube, or from sheet material which is suitably folded and subsequently is seam-welded to make a tube. End panels for a liner are provided either by welding the plastics material in an appropriate manner or by bonding into the tube a separate end panel. Access openings are provided both for the loading and discharge of the liner, when in use, and also suitable arrangements must be made for the fixing of the liner in a container.

The manufacture of such a container liner tends to be somewhat labour intensive. Typically, a rolled web of the plastics material is supported adjacent a work-table and is drawn out over that work-table so that the required operations may be performed by operators reaching across the liner and using suitable tools, such as thermal welding apparatus. In view of the width of such a liner, these operations are not very easy to perform in the central region of the liner where, for example an access opening may have to be provided. A high degree of skill is required to ensure the welding or other bonding processes are carried out efficiently to provide a reliable joint which will not fail in use.

In U.S. Pat. No. 3,853,664, there is described apparatus for making bags on an automatic basis from a travelling web of plastics material folded to have inwardly-directed panels which when opened out define sides of the bag. The operations described in this specification serve to form the ends of the bag, by diagonally-extending welds.

In U.S. Pat. No. 3,069,303-A there is described a process and apparatus for converting a tube of thermoplastic flexible sheet material in an automatic matter to form an endwise closed container adapted to be filled with milk. A nozzle is secured to a side wall of the container using a floating mandrel within the tube, to act as a counter force for a piercing and heat-sealing operation. The mandrel is maintained in a substantially fixed position by means of cradle roll pairs acting through the walls of the tube.

A principal object of the present invention is to provide both a method of and apparatus for the manufacture of relatively large-scale cargo container liners, which are suitable for at least partial automation, so as to reduce the labour intensive nature of the known cargo container liner manufacturing processes whilst at the same time giving at least as good and consistent reliability for the manufactured liners, as is achieved by the known manual processes.

According to one aspect of this invention, there is provided a method of manufacturing a bulk transport cargo container liner from a web of folded-flat gussetted sheet plastics material having over-lying upper and lower layers between the long edges of which are respective pairs of inwardly-folded gusset panels, which method comprises the steps of:

extending the web over a work-area and arranging a shuttle between the layers of the material, which shuttle extends substantially across the width of the web so as to hold separated layers of the plastics material above and below the shuttle and with the side edge margins of the shuttle located between the upper layer and the adjacent inwardly-folded gusset panels;

defining in the web a first end region for the finished liner;

advancing the web over the work-area whilst applying a force to the shuttle through the plastics material so as to maintain the shuttle substantially stationary with respect to the work-area, until a part of the material corresponding to a required location for an attachment of the finished liner over-lies the shuttle;

bonding to the plastics material at said location an attachment for the liner, using the shuttle to provide a counter-force for bonding operation;

further advancing the web over the work-area whilst continuing to maintain the shuttle stationary with respect to the work-area, until the required length of plastics material for the finished liner extends beyond a closure station downstream of the shuttle;

providing at the closure station a pair of separator boards disposed one each side of the web and each projecting between the folded material defining the gusset panels thereby separating the upper and lower gusset panels;

effecting at the closure station upper and lower weld seams across the width of the web thereby to join the upper and lower layers to the respective upper and lower gusset panels with the weld seams on each layer being in a generally V-shaped configuration thereby to form an end panel at a second end region of the liner; and cutting the plastics material from the web so at least partially completing the liner.

According to another, but closely related, aspect of the present invention, there is provided apparatus for the automated production of a bulk transport cargo container liner, comprising:

a holder for a reel of liner-forming folded-flat gussetted sheet plastics material web having over-lying upper and lower layers between the long edges of which are respective pairs of inwardly-folded gusset panels;

means to draw the web from a held reel thereof and advance the web over a work-area;

a shuttle adapted for location between the layers of the web, which shuttle extends substantially across the width of the web to hold separated the layers of the plastics material above and below the shuttle with the side edge margins of the shuttle located between the upper layer and the adjacent inwardly-folded gusset panels, the shuttle being disposed over the work-area and being provided with means to maintain the shuttle substantially stationary during advancement of the web;

gripping means for an attachment for the liner and arranged to move said attachment into engagement with the web at a location where the attachment is to be secured to the liner;

a plastics bonder adapted to effect a bonding operation of the engaging surfaces of the web and the attachment;

a pair of separator boards provided at a closure station, one each side of the web and each projecting between the folded material defining the gusset panels, thereby separating the upper and lower gusset panels;

seam-welding apparatus disposed at the closure station to effect upper and lower weld seams across the width of the web thereby to join the upper and lower layers to the respective upper and lower gusset panels with the weld seams on each layer being in a generally V-shaped configuration thereby to form an end panel at a second end region of the liner; and a web-cutter to sever a length of web material drawn from the reel, so as at least partially to form the liner.

It will be appreciated that both aspects of this invention allow the manufacture of a cargo container liner from a web of folded-flat sheet plastics material, on at least a semi-automated basis if not a fully-automated basis. The plastics material may be pre-formed to be a tube, in which case it may have inwardly-folded gussets extending along the length of both sides of the flat tube. Such tubes are already used for the manufacture of liners and typically the inner edges of the gussets more or less meet in the central region of the tube, when flat. In the alternative, the sheet may be in the form of an elongate web simply folded to provide two overlying layers with adjacent side edges and which edges may be seam-welded together during the manufacturing process to provide the main part of the liner, when completed.

In the method, the shuttle is located between the layers of the web, so as to permit the required manufacturing operations to be performed on one layer (usually the upper layer) without affecting the underlying layers. Such operations may include thermal welding to the upper layer, and the cutting of openings through the upper layer. As the web is drawn out over the work-area, typically from a reel of the plastics sheet material arranged at one end of the work-area, the shuttle must be maintained stationary and so in effect run through the moving web. This may be achieved by the interaction of magnetic materials respectively on the shuttle and associated with the work-area. For example, a plurality of permanent magnets may be provided on the shuttle and a like plurality of magnets (either permanent magnets or electromagnets) may be provided on the work-area in the same physical array, whereby each shuttle magnet may directly co-act with a corresponding magnet on the work-area.

In an alternative arrangement, the shuttle is provided with at least one roller and there is at least one further roller mounted externally of the web to interact with the shuttle roller through a layer of the sheet plastics material, thereby to maintain the shuttle substantially stationary during advancement of the web.

As with the known manual manufacturing techniques, the end panels of the liner may be defined by suitably profiled and positioned welds or other bonds formed across the web and any gussets formed therewith, or by separate panels let into the web and bonded in position thereby to define the liner ends.

In a typical manufacturing method, a plurality of attachments are secured to the plastics material forming the liner. For example, such attachments may comprise fixing devices, such as suspension or retention devices, for the liner, when in use. Alternatively, or in addition, the attachment could comprise an access-pipe, in which case an opening may be cut through the liner at the required location for the access-pipe, before or after the bonding of the access-pipe to the plastics material. In this case, the shuttle may act as a counterforce for the cutting step which forms the opening, as well as for the bonding step. When there is more than one attachment, these may be spaced along the length of the liner, which is correspondingly advanced step-wise along the work-area.

The bonding operation securing each attachment to the liner may comprise one of an adhesive bonding step, a chemical fusion step or a thermal welding step.

In one embodiment, the underside of the shuttle is provided with at least one running roller which runs on a surface of the work-area, through the or each underlying layer of the plastics sheet material below the shuttle. Preferably, a plurality of such rollers are provided, to support the entire weight of the shuttle. Each such roller may be in the form of a caged freely-rotatable ball, able to roll in any direction in the plane of the work-area, thereby to facilitate centralisation of the shuttle as the web is advanced.

A pair of lower rollers may be provided in the work-area for each roller of the shuttle, whereby each shuttle roller is located by and runs on its associated pair of lower rollers, with the web running between the lower rollers and the shuttle rollers. Such lower rollers may be free-running, or could be power-driven, to facilitate advancement of the web. In either case, the primary positioning of the shuttle may still be the use of magnets, as aforesaid.

In another embodiment, the shuttle rollers may be power-driven by a remote control system responsive to the drawing of the web over the work-area; in this way, the shuttle may be maintained stationary during advancement of the web. Power may be supplied to such a remote control system by an electrical, pneumatic, hydraulic or other power-recharging operation which connects with the shuttle when stationary for the bonding of an attachment to the web. Alternatively, an optical or inductive power coupling system from an external (of the web) power source may be used.

In a case where the web is a simple folded plastics sheet material with adjacent long edges, the shuttle may be maintained stationary by means of an arm connecting the shuttle to a stationary part of the apparatus, which arm extends out of the web, between the adjacent long edges thereof. In this case, the long edges may be joined downstream of the arm by means of a continuous seam-welding operation, to form a complete liner.

As mentioned hereinbefore, the attachment may be an access-pipe leading to the interior of the liner. Such an access-pipe may comprise a pipe of flexible plastics material cut from a web thereof. The end portion of such a pipe may be stretched to form a flange which is engaged with a corresponding surface of the plastics material of the liner around an opening formed therein, the engaging surfaces then being bonded together. Where such bonding is performed by welding, the shuttle itself may provide a thermal source for the bonding operation, or a separate welding head may be provided for this purpose.

The web for forming into the liner is a tube having, when folded flat, inwardly folded gussets, the shuttle extending across the width of the web to the fold lines at the edges of the upper layer of the web. The shuttle may have gusset boards which are adjustable with respect to the central part of the shuttle, such that the outer edges of the boards locate closely adjacent the edges of the upper layer of the web. This permits the accurate location of the shuttle with respect to the liner, and also the securing of attachments to the side edge regions of the upper layer of the web forming the liner, but not to the underlying layers.

By way of example only, certain specific embodiments of container liner manufacturing methods and apparatus will now be described in detail, reference being made to the accompanying drawings, in which.

Figure 13:
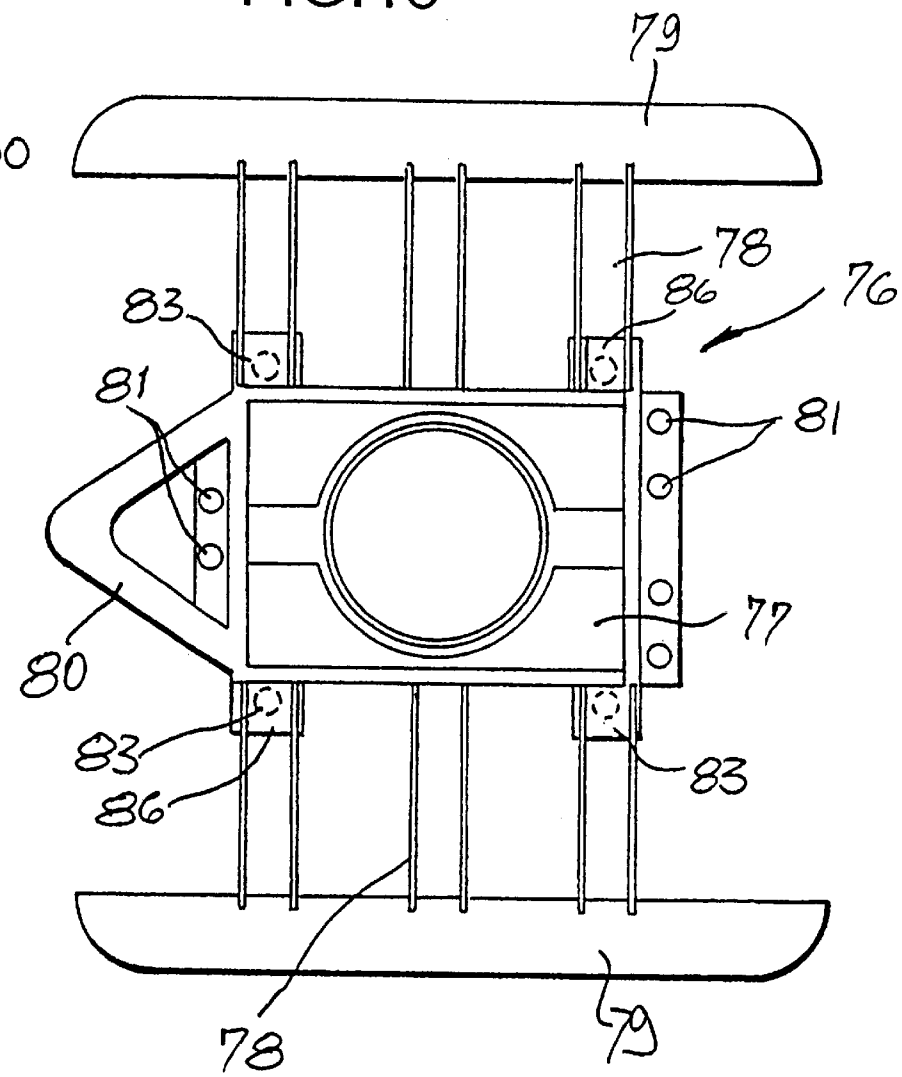
FIG. 13 illustrates another shuttle design.
Figure 17:
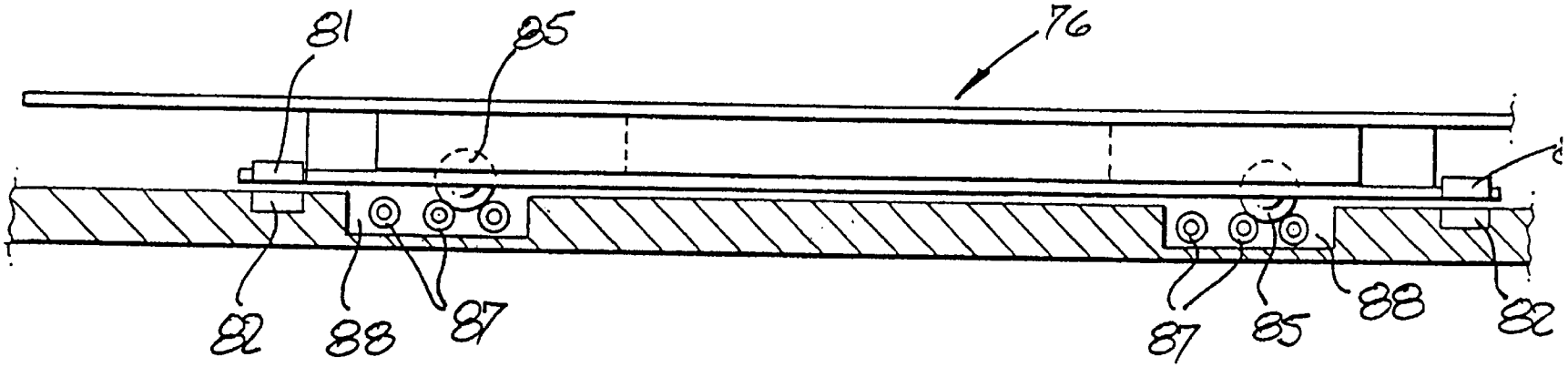
Figure 16:
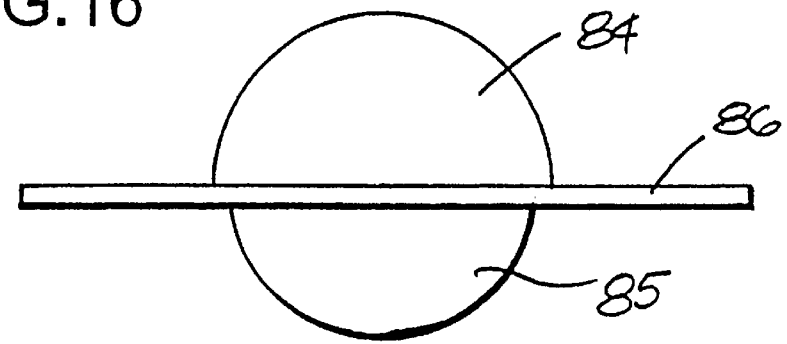

FIG. 16 diagrammatically illustrates the mounting of a ball supporting the shuttle of FIG. 13;

FIG. 17 is a side view of the shuttle of FIG. 13, on the worktable; and

Figure 18:
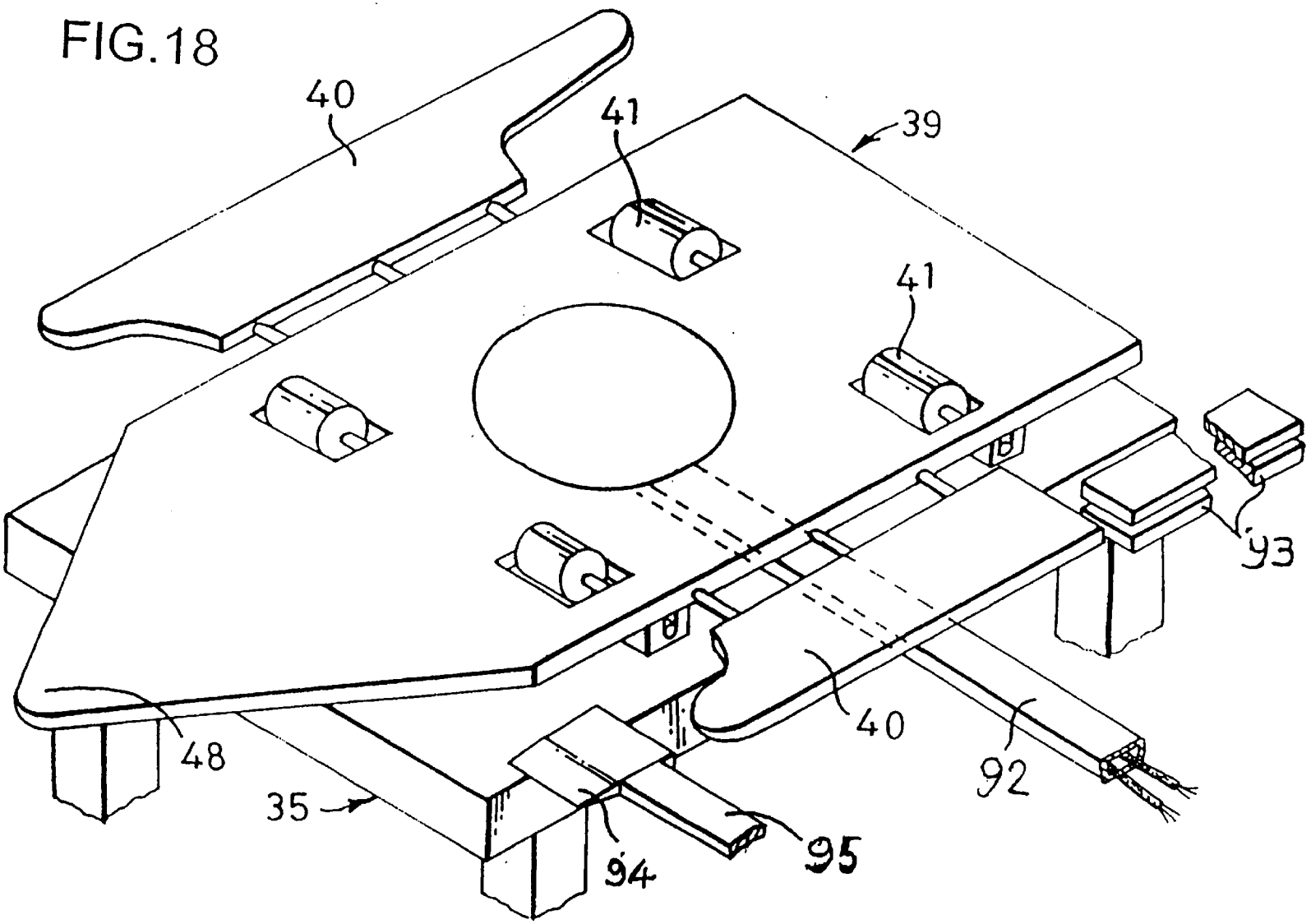

FIG. 18 shows yet another shuttle arrangement, for use with a web in the form of a folded sheet, or a tube.

Figure 1:
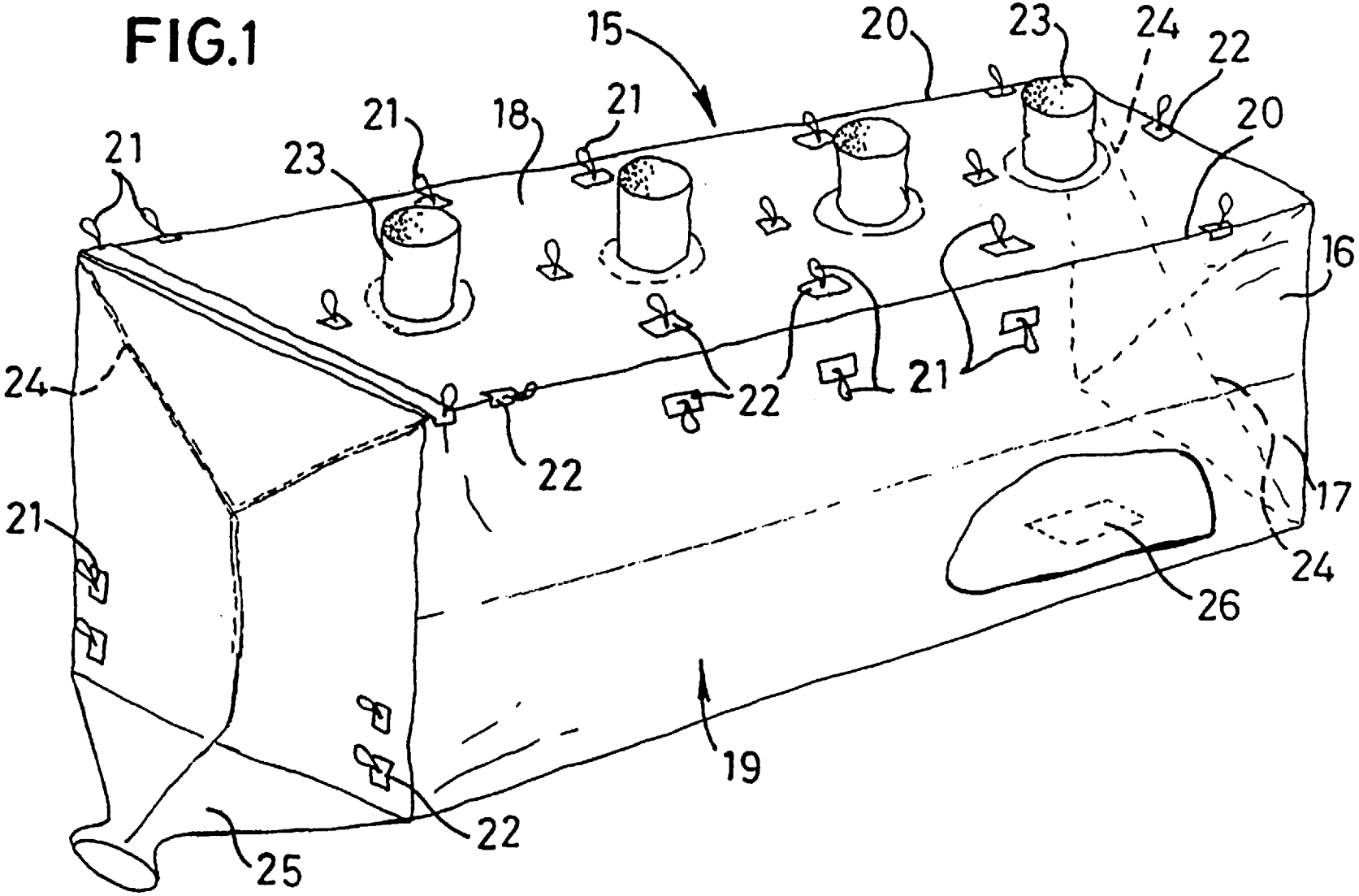
FIG. 1 is a general perspective view of a container liner of the kind with which the present invention is concerned.

Referring initially to FIGS. 1 and 2, there is shown a container liner 15 manufactured from flexible plastics tubular material which originally was folded flat with inwardly folded gussets 16, 17 between the upper and lower layers 18, 19. When opened out, the gussets 16, 17 form the side walls of the liner, with a crease line therebetween.

Provided adjacent the upper edges 20 of the liner, as well as on the sides 16 and ends thereof, are suspension devices 21, each in the form of a loop of an elasticated cord secured to the liner by means of a small panel 22 bonded to the liner, for example by thermal welding. A similar row of suspension devices 21 extends centrally along the upper layer 18. Also provided on the upper layer of the liner are four access-pipes 23 each bonded to the liner around a respective opening therein.

The end panels of the liner are defined by welds 24 formed between the upper and lower layers and the respective gussets, during the manufacturing operation. At the end of the liner intended to be situated at the door end of a cargo container within which the liner is installed there is a discharge funnel 25. This may be separately formed and attached to the liner during manufacture, or could be formed by suitable cutting and welding of the web of plastics material from which the liner is made. At the forward end of the liner, there is a reinforced panel 26, to assist the securing of the liner to the floor of a cargo container, in a manner known per se.

Figure 2A:
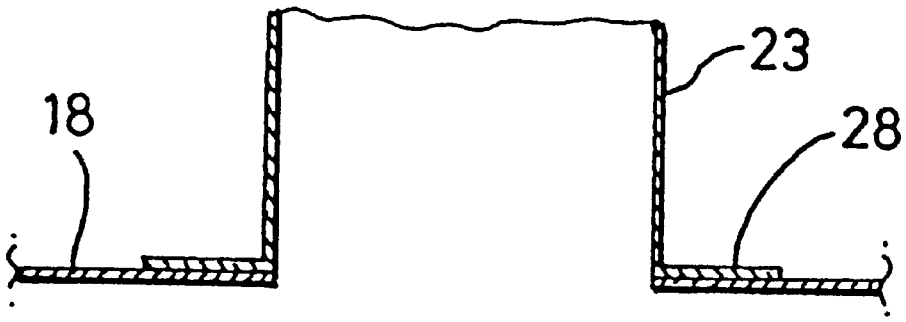
FIGS. 2A, 2B and 2C show three different attachment techniques for access-pipes.
Figure 2B:
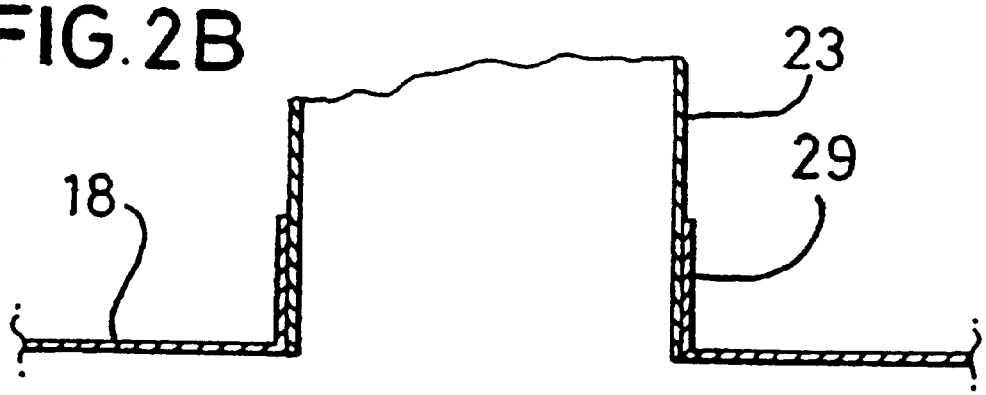
Figure 2C:
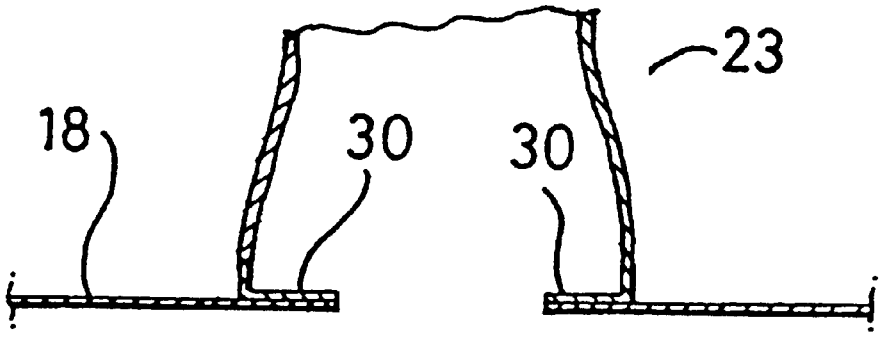

FIG. 2 illustrates various possible attachment techniques for an access-pipe. In FIG. 2A, the end portion of the access-pipe 23 is stretched outwardly to form an external flange 28 which is bonded to the external surface of the upper layer 18 of the liner, after an aperture has been cut therethrough. In FIG. 2B, the upper layer of the liner is stretched so as to define a lip 29 within which the access-pipe is located and is then bonded thereto. In FIG. 2C, the end portion of the access-pipe is stretched radially and the very end portion 30 is allowed to take up its natural shape, so forming an inwardly directed flange. That flange may then be bonded to the upper layer 18 of the liner, around the opening therein.

Figure 3:
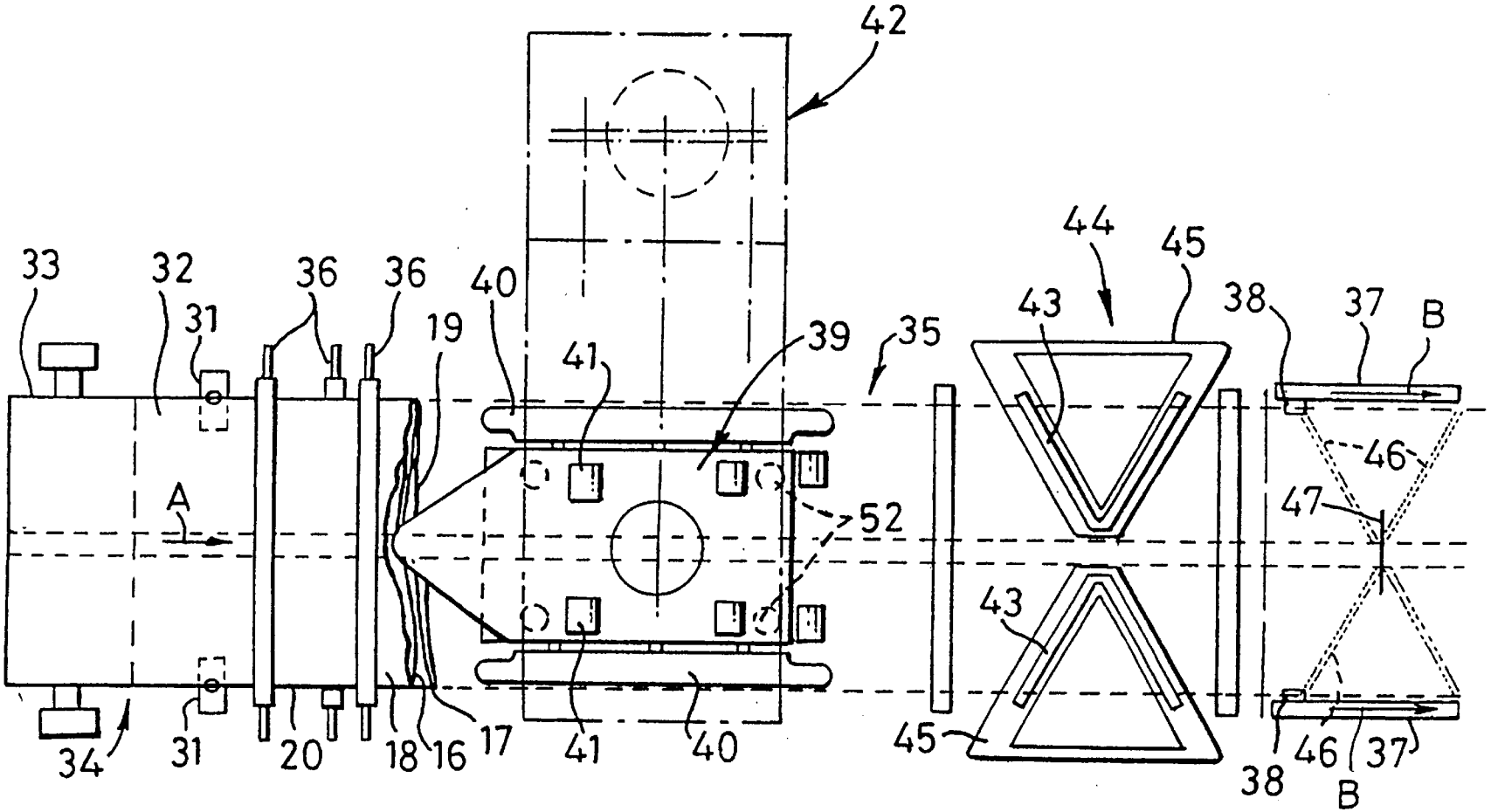
FIG. 3 is a diagrammatic plan-view of apparatus configured for performing the method of this invention.

Referring now primarily to FIG. 3, there is shown an embodiment of apparatus of this invention configured automatically to manufacture container liners as described above. A web 32 of plastics material preformed into a folded-flat tube with inwardly folded gussets is wound on a reel 33 supported at end 34 of the production line, for drawing out in the direction of arrow A over a work-table 35. Rollers 36 may be arranged to facilitate the drawing of the web by isolating the reel from stepwise movement of the web, as well as to measure the length of web drawn from the reel. The drawing may be achieved by linear actuators 37 arranged at the other end of the work-table, each having a gripper 38 arranged to hold a marginal region of the web and to move along the length of the web in the direction of arrows B. Other arrangements could be provided such as a continuously running gripper track. Web edge guides 31 are provided at end 34 of the production line, to centre the web on the work-table 35.

A shuttle 39 (see also FIGS. 4 to 6) runs on the work-table 35, within the web 32. The shuttle has adjustable gusset boards 40 arranged to locate closely adjacent the outer edges of the upper layer 18 of the web, between that upper layer and the upper gusset. The shuttle includes rollers 41 which run on the work-table, through the underlying layers of the web. A magnetic arrangement is provided to hold the shuttle stationary, as will be described in further detail below.

Diagrammatically illustrated at 42 is a mechanism to feed attachments for bonding to the liner, when stationary. The attachments may typically comprise access-pipes 23, suspension devices 21 or the like. In the case of an access pipe, the mechanism 42 cuts a suitable length of pipe material, or lifts a length from a stock thereof, and transports the attachment to the appropriate site for bonding to the liner when stationary, with the shuttle 39 serving as a counter-force for that bonding operation. For this purpose, the mechanism 42 includes one or more movable grippers for the attachment, together with a welder of a configuration suitable for the attachment.

Though in FIG. 3 there is shown only one station at which an attachment is secured to a liner, a practical installation may have several such stations. In addition, or alternatively, several attachments besides just the tube may be bonded to the liner at the or each station. For this purpose various mechanisms may be provided, including robot arms, automated tube handling apparatus and so on.

Figure 9:
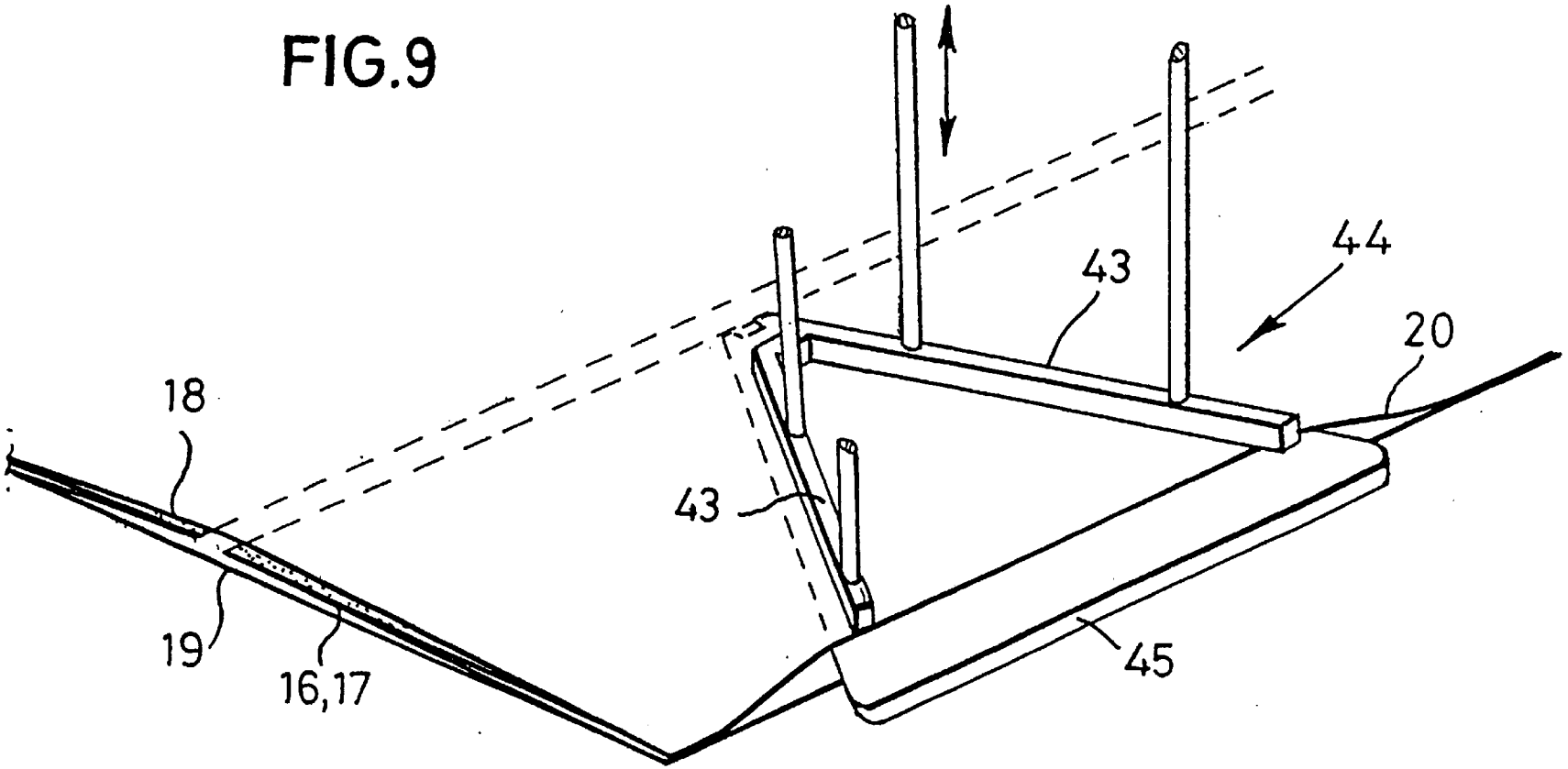
FIGS. 9 and 10 show the welding of a gusseted tubular web to form end panels of two adjacent liners.
Figure 10:
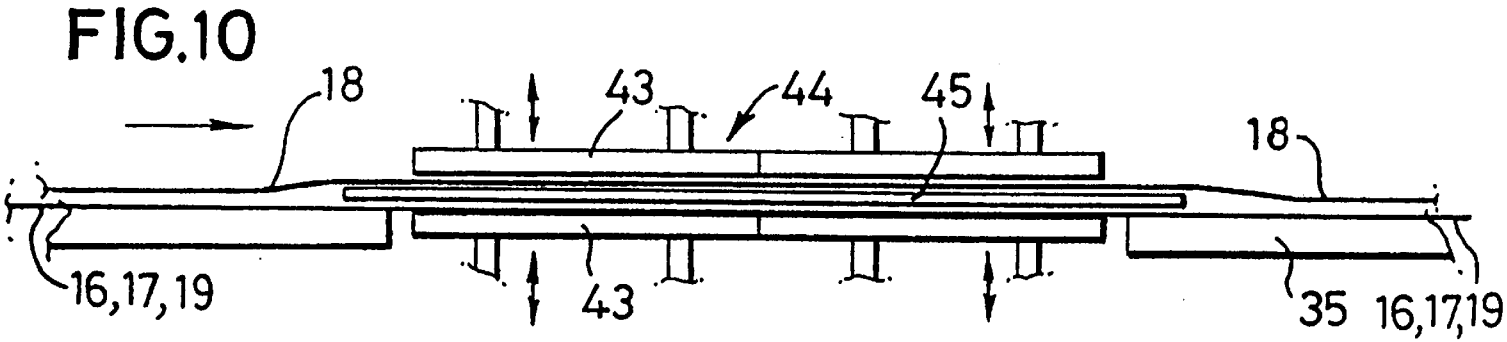

Downstream of the shuttle, there is a thermal welder 44 arranged to form V-shaped welds on both sides of the web, between the upper layer 18 and the underlying upper gusset panel 16 and simultaneously (if required) between the lower layer 19 and the overlying lower gusset panel 17. The gusset panels on both sides of the web are held apart during this operation by means of separator boards 45 (FIGS. 9 and 10) inserted between the gusset panels 16, 17, on each side. The thermal welder has V-shaped thermal welding bars 43 mounted for vertical reciprocation and provided with electrically powered heaters (not shown) whereby on moving closer together and engaging the respective upper or lower layer, that layer is welded to the immediately adjacent gusset panel along the lines of the welding bars.

The formation of the welds 46 in this manner creates end panels from the material of the web itself, both for the already manufactured liner and for the liner about to be manufactured, upstream of the welder. Finally, those two liners are separated by means of a cutting device 47 which separates an already-manufactured liner from the liner currently undergoing manufacture. Simultaneously a final weld is effected in the central region between and connecting the gussets, so completely closing each end panel.

Figures 4, 4A:
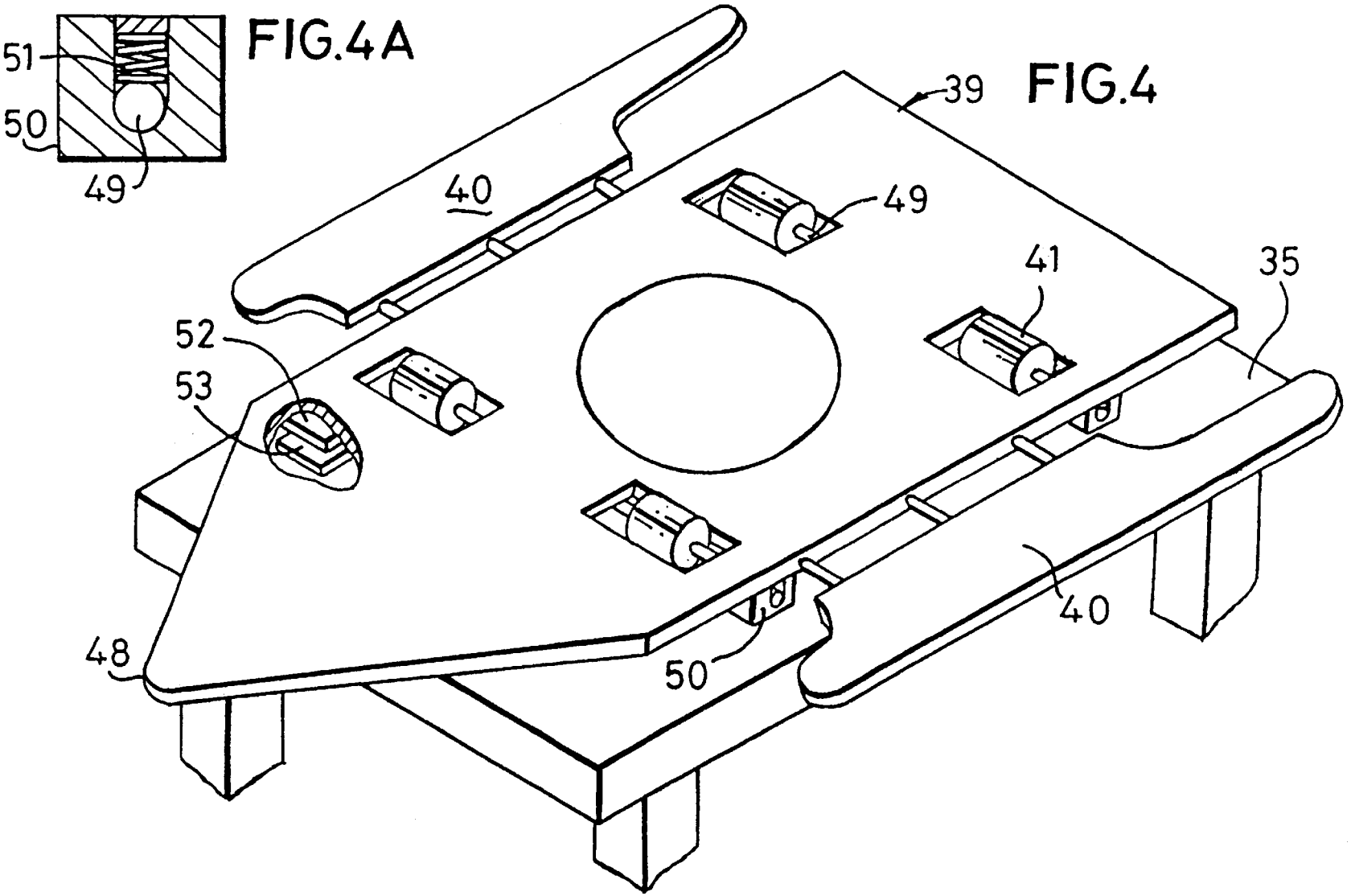
FIG. 4 shows a shuttle used in the apparatus of this invention, FIG. 4A being a detailed view on an enlarged scale of a suspension arrangement for the shuttle.
Figure 5:
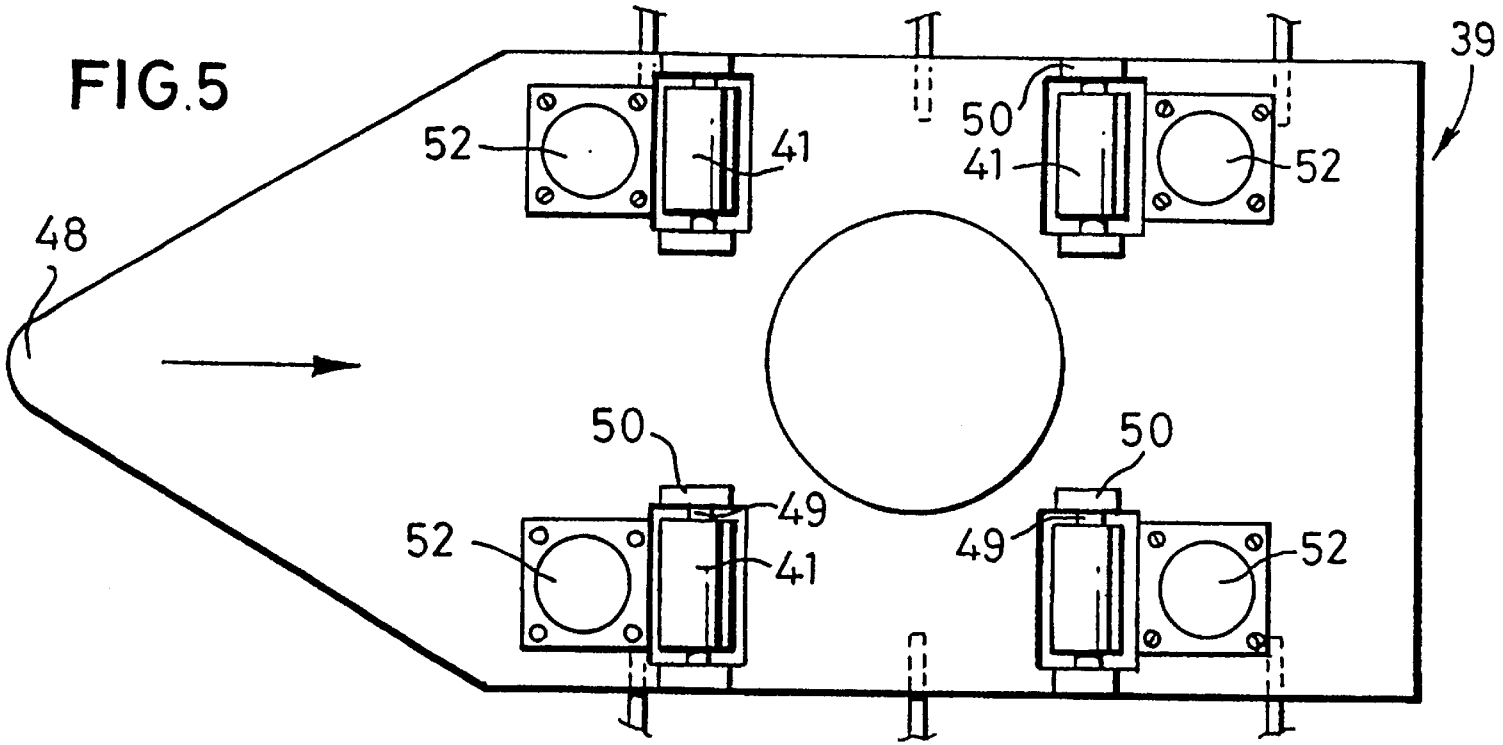
FIG. 5 is an under-plan view on the shuttle of FIG. 4.
Figure 6:
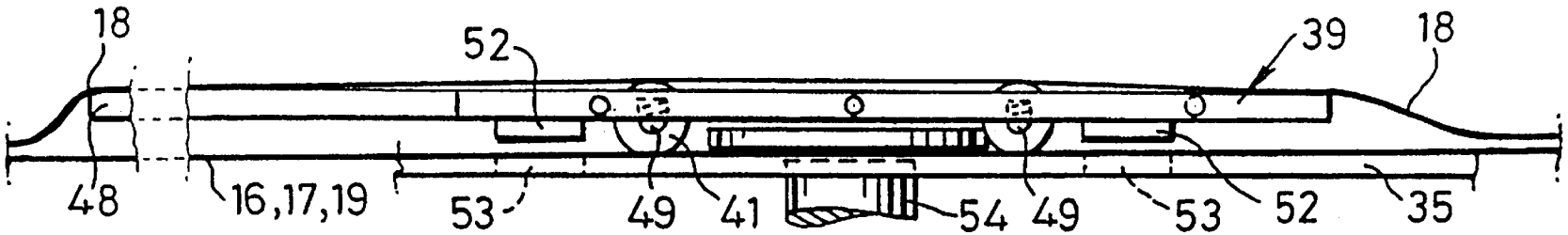
FIG. 6 is a side-view of an alternative form of the shuttle, on the work-table together with a support ram.

Referring now to FIGS. 4 to 6, there is shown in further detail the shuttle 39. This has a pointed leading edge 48 to facilitate advancement of the shuttle through the web as the web is drawn over the work-table. Each pair of rollers 41 is mounted on a respective shaft 49 carried in housings 50 provided with springs 51 (FIG. 4A). in this way, the shuttle is normally supported by the rollers 41 but may be pressed down against the action of the springs, so that the housings 50 engage the work-table 35 to transfer reaction from the shuttle to the work-table.

The shuttle is normally maintained stationary with respect to the work-table by means of four permanent magnets 52 secured to the underside of the shuttle, one adjacent each side of the roller 41 and co-acting with four magnets 53 in corresponding positions and let into the upper surface of the work-table 35. The magnets 53 could also be permanent magnets, or could be electromagnets which are energised when the shuttle is to be maintained stationary, notwithstanding feeding of the web, but which may be de-energised when the shuttle is to move freely, for example during setting up of the apparatus.

With the shuttle shown in FIG. 6, the shafts 49 carrying the rollers 41 are directly mounted to the shuttle. In order to relieve the rollers of a downward load when the shuttle is offering a reaction to a cutting or an attaching operation, a support ram 54 is provided in the work-table and which may be raised upwardly to engage the underside of the shuttle 39.

Figure 7:
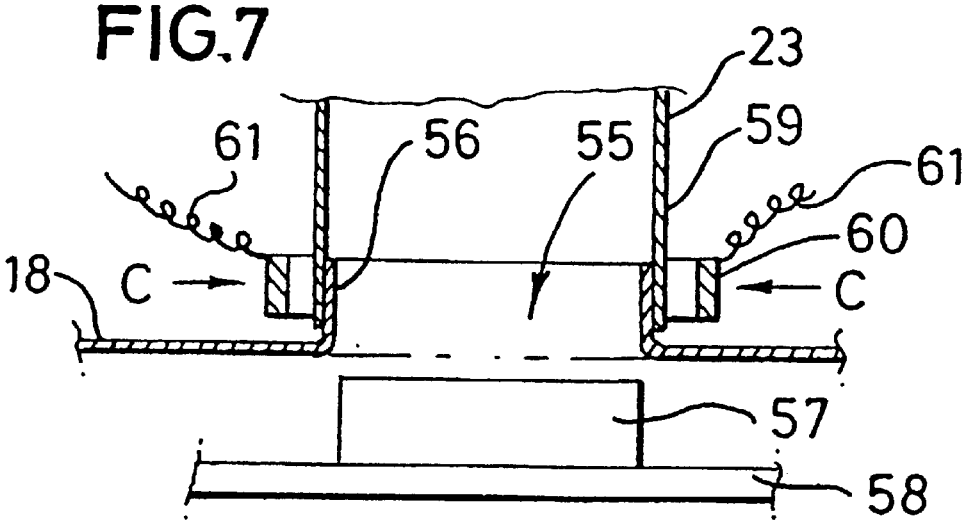
FIG. 7 is a detailed view showing an access-pipe welding arrangement.

FIG. 7 shows yet another attachment technique for an access-pipe to the upper layer 18 of the liner. Here, following the formation of a circular opening 55 in the upper layer, for example by a die-cutting operation with the shuttle acting as a counter-force therefor, the material 56 of the liner around that opening 55 is deformed upwardly by means of a plug 57 provided on the shuttle 58. The end portion 59 of the access-pipe is lowered over the upturned material 56 and then a ring-shaped thermal welder 60 operates to weld together the overlying parts of the access-pipe and the liner material 56. Typically, the ring welder has two arcuate welding segments each of which may move radially inwardly in the direction of arrow C until contacting the access-pipe; to secure a bond between the access-pipe and the material 56, the ring welder may perform a first welding step, and then be rotated through a predefined angle and perform a second welding step, thereby completing a 360° weld around the access-pipe. Power is supplied to the ring welder by means of flying cables 61.

Figure 8:
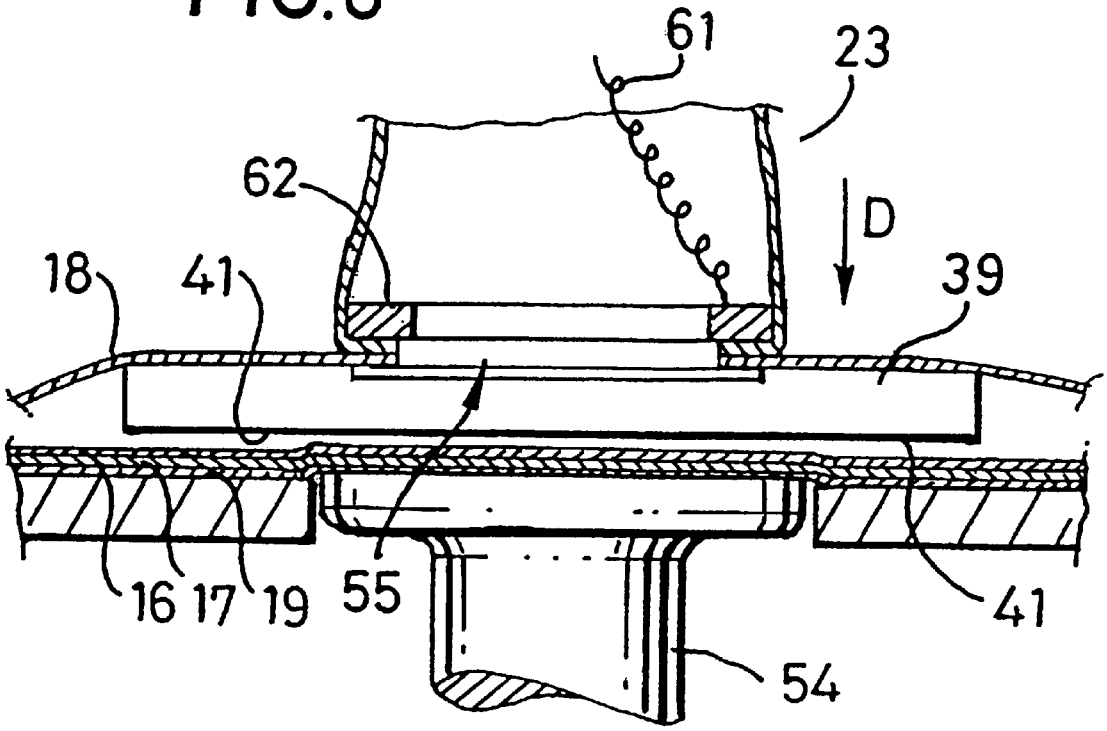
FIG. 8 is a detailed view of an alternative form of access-pipe welding arrangement.

FIG. 8 shows an alternative welding arrangement, using the ram 54 (FIG. 6) to provide a counter-force. Here, following the cutting of an opening 55 in the upper layer 18 of the web, an access-pipe is lowered on to the upper layer so as to encircle that opening. Power is fed to a welding ring 62 carrying the end portion of the access-pipe and applies force to that end portion in the direction of arrow D, to weld together the access-pipe and the upper web layer.

Figure 11:
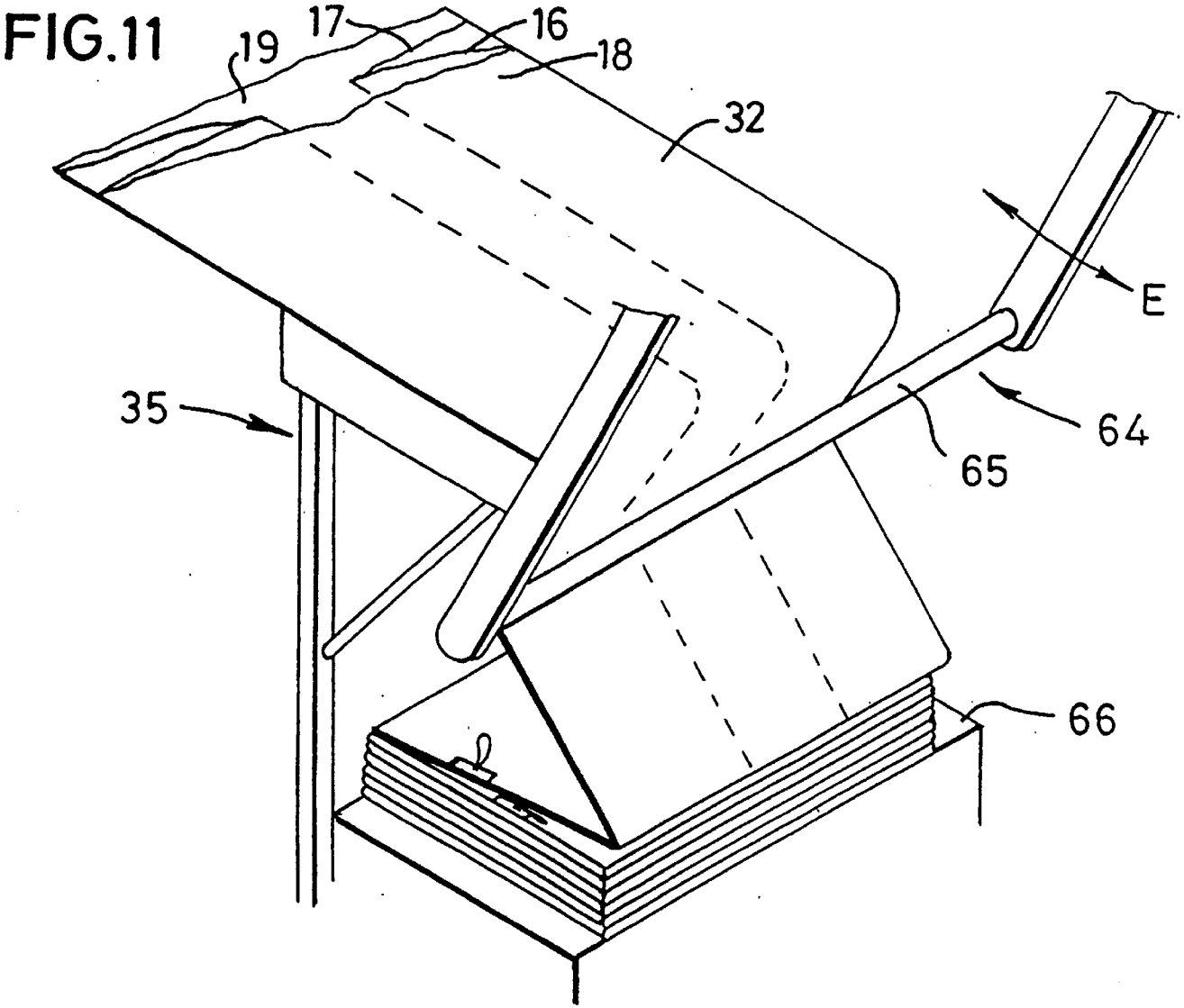
FIG. 11 is a folder for a manufactured liner.

At the downstream end of the apparatus shown in FIG. 3 (i.e. the right-hand end), a completed liner folder mechanism 64 is provided (FIG. 11), this having a folding bar 65 mounted for swinging movement in the direction of arrow E and arranged to fold the completed liner concertina-wise on to an accumulation table 66. In this way, a completed liner may be folded down for storage and transport.

Figure 12:
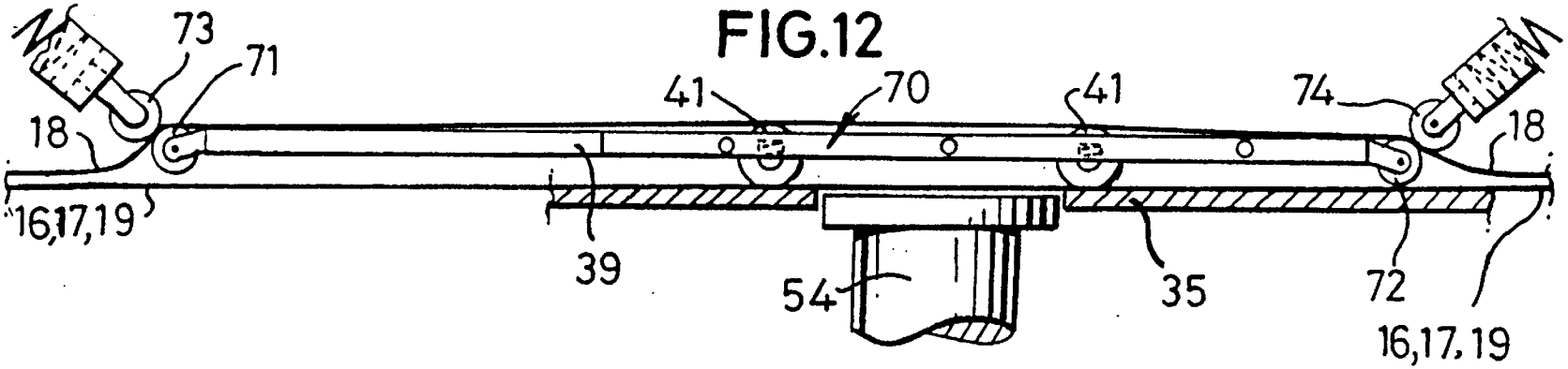
FIG. 12 illustrates an alternative technique for maintaining stationary the shuttle during advancement of the web.

FIG. 12 shows an alternative form of shuttle 70, provided at its two ends with respective rollers 71 and 72. Externally of the web within which the shuttle is located, there are two spring loaded rollers 73 and 74 respectively disposed to engage the rollers 71 and 72. Despite drawing of the web over the work-table 35 during the manufacture of a liner, in the manner described above, the shuttle will be maintained substantially stationary by virtue of the interaction of the pairs of rollers 71, 73 and 72, 74. In this case, the magnets described above are not necessary.

Referring now to FIGS. 13 to 17, there is shown another shuttle 76, which may be used instead of either of those described above. This shuttle has a main body 77 which supports on arms 78 a pair of adjustable gusset boards 79. The central region of the main body is configured to permit the bonding of an access pipe to a liner, as has been described above and at the forward end of the body, there is a generally pointed lead plate 80. Across the two ends of the main body, there are four permanent magnets 81, to interact with suitably positioned stationary magnets 82 let into the work-table, again as described above.

At the inner end of each of the four end arms 78 but attached to the shuttle there is provided a ball transfer unit 83, in the form of a housing 84 (FIG. 16) holding a freely-rotatable ball 85, the housing surrounding more than 180° of arc of the ball, so that the ball is held captive. The housing includes a mounting plate 86, by means of which each transfer unit 83 is secured to the shuttle. In this way, the shuttle is free to roll on the balls 85 in any direction in the plane of those balls. Though not shown, the central area of the shuttle could also be provided with ball transfer units.

Figure 15:
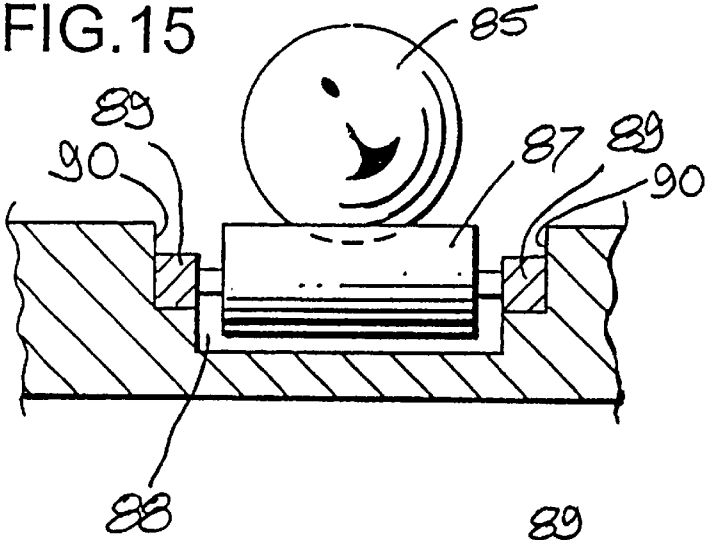
FIGS. 14 and 15 are detail views on the roller support mechanism for the shuttle of FIG. 13.
Figure 14:
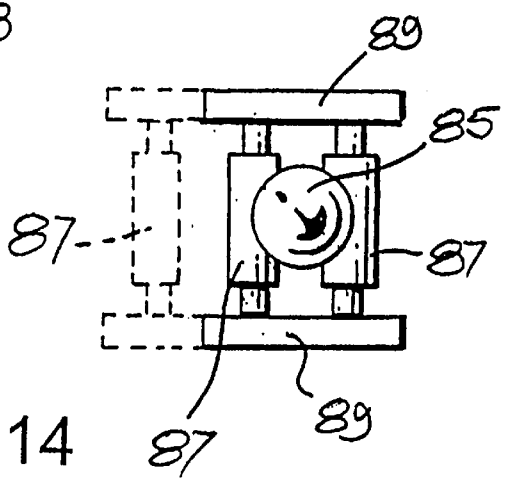

The work-table includes, for each transfer unit 83, three parallel freely-rotatable rollers 87 let into a recess 88 in the work-table. Each group of rollers 87 are carried on a respective sub-frame 89 which is received on rebates 90 along the edges of the associated recess 88. Normally, the respective ball 85 is received between the rear two rollers 87, as shown in FIG. 17, but under abnormal conditions, the shuttle may be pulled forward by the advancing web, so that the balls 85 jump over the central roller and are located between the front two rollers. On clearing the cause of the abnormal condition, the balls may move back to the normal position, either just under the action of the magnets or with external assistance. As shown in FIG. 15, it would be possible to omit the forward roller and simplify the construction of the roller arrangement, by providing only two rollers 87.

The arrangement of FIGS. 13 to 17 allows the shuttle 76 to move laterally within a liner under manufacture, so as to find the central position within that liner. Moreover, as the liner is drawn between the balls and the associated rollers, there is minimal friction and no sliding surfaces, so minimising the likelihood of the liner being marked or even damaged. In other respects, the shuttle 76 is used in the manufacture of a liner as has been described above with reference to shuttle 39 and will not therefore be described in further detail here.

When the liner is to be manufactured from a simple folded sheet of plastics material, not pre-formed into a tube, as shown in FIG. 18 the shuttle 39 (or some other shuttle) may be maintained stationary by means of a rigid arm 92 secured to and projecting laterally from one side of the shuttle. The outer end of the arm, remote from the shuttle, may be secured to any convenient fixed part of the work-table 35. The plastics material may be drawn over the work-table in the manner described above, during the manufacture of a liner, and the arm 92 will hold the shuttle stationary, ready to provide a counterforce for the attachment operations described above. Conveniently, the arm 92 may be hollow and power cables, for example for a welding operation to be performed by the shuttle, may extend through the arm. Following those operations, the adjacent long edges of the folded sheet may be seam-welded together, for example by means of a seam-welder diagrammatically illustrated at 93 and secured to a fixed part of the work-table 35. In the alternative, the seam-welding operation may be performed subsequently, remote from the shuttle—for example, during the welding of the end panels.

Such a configuration would also be possible with a web pre-formed into a tube. In this case, it would be necessary to slit open the tube upstream of the arm 92, for example by means of a slitting knife diagrammatically illustrated at 94 in FIG. 13 and supported by a further stationary arm 95.

What is claimed is:

1. A method of manufacturing a bulk transport cargo container liner from a web of folded-flat gussetted sheet plastics material having over-lying upper and lower layers between the long edges of which are respective pairs of inwardly-folded gusset panels, which method comprises the steps of:

extending the web over a work-area and arranging a shuttle between the layers of the material, which shuttle extends substantially across the width of the web so as to hold separated layers of the plastics material above and below the shuttle and with the side edge margins of the shuttle located between the upper layer and the adjacent inwardly-folded gusset panels;

defining in the web a first end region for the finished liner;

advancing the web over the work-area whilst applying a force to the shuttle through the plastics material so as to maintain the shuttle substantially stationary with respect to the work-area, until a part of the material corresponding to a required location for an attachment of the finished liner over-lies the shuttle;

bonding to the plastics material at said location an attachment for the liner, using the shuttle to provide a counter-force for bonding operation;

further advancing the web over the work-area whilst continuing to maintain the shuttle stationary with respect to the work-area, until the required length of plastics material for the finished liner extends beyond a closure station downstream of the shuttle;

providing at the closure station a pair of separator boards disposed one each side of the web and each projecting between the folded material defining the gusset panels thereby separating the upper and lower gusset panels;

effecting at the closure station upper and lower weld seams across the width of the web thereby to join the upper and lower layers to the respective upper and lower gusset panels with the weld seams on each layer being in a generally V-shaped configuration thereby to form an end panel at a second end region of the liner; and cutting the plastics material from the web so at least partially completing the liner.

2. A method as claimed in claim 1, wherein an end panel is formed at the first end of the liner by welding seams across the width of the web in substantially the same manner as at the second end region of the liner, or by cutting the web with a predetermined profile in readiness for the attachment thereto of a separate end panel.

3. A method as claimed in claim 1, wherein simultaneously with the welding of seams to form the second end of the liner, further adjacent seams are welded to form the first end of the next liner to be manufactured.

4. A method as claimed in claim 1, wherein the bonding operation is selected from the group consisting of an adhesive bonding step, a chemical fusion step and a thermal welding step.

5. A method as claimed in claim 1, wherein the attachment secured to the plastics material is at least one of a suspension device and a retention device for the liner, when in use.

6. A method as claimed in claim 1, wherein the attachment comprises at least one access pipe to give access to the interior of the liner, a cutting step being performed before bonding the access pipe to the plastics material in which cutting step an opening is formed through the liner at the required location for the access pipe, with the shuttle acting as a counter-force during the cutting step.

7. A method as claimed in claim 6, wherein the end portion of a length of plastics material pipe to form the access pipe is engaged with a corresponding surface of the plastics material of the liner around the opening formed therein, the engaging surfaces then being bonded together.

8. A method as claimed in claim 1, wherein the shuffle is maintained stationary within the folded-flat plastics material during the advancement thereof by interaction of permanent or electro-magnetic materials provided respectively on the shuttle and the associated work-area, whereby each shuttle magnet may directly co-act with a corresponding magnet on the work-area.

9.A method as claimed in claim 1, wherein the shuttle is provided with at least one roller and there is at least one further roller mounted externally of the plastics material to interact with the shuttle roller through a layer of the plastics material, thereby to maintain the shuttle substantially stationary during advancement of the web.

10. A method as claimed in claim 1, wherein the shuttle runs on the or each layer of the plastics sheet material below the shuttle and supported on the work-area, by means of at least one running roller or freely rotatable ball provided on the underside of the shuttle.

11. A method as claimed in claim 1, wherein the shuttle has motor-driven supporting wheels and a remote control system is used to control the driving of the wheels to maintain the shuttle stationary during advancement of the web.

12. A method as claimed in claim 1, wherein the web of folded-flat sheet plastics material has two opposed long edges, and the shuttle is held stationary by an arm projecting laterally therefrom and secured to a fixed component, which arm extends out of the folded-flat sheet plastics material at a long edge thereof, a seam bonder being arranged downstream to the arm to unite the material along said long edge to form a tube.

13. A method as claimed in claim 1, wherein two or more attachments are bonded to the plastics material at spaced locations along the length thereof.

14. A method as claimed in claim 1, wherein the folded-flat gussetted sheet plastics material is of tubular form.

15. Apparatus for the automated production of a bulk transport cargo container liner, comprising:

a holder for a reel of liner-forming folded-flat gussetted sheet plastics material web having over-lying upper and lower layers between the long edges of which are respective pairs of inwardly-folded gusset panels;

means to draw the web from a held reel thereof and advance the web over a work-area;

a shuttle adapted for location between the layers of the web, which shuttle extends substantially across the width of the web to hold separated the layers of the plastics material above and below the shuttle with the side edge margins of the shuttle located between the upper layer and the adjacent inwardly-folded gusset panels, the shuttle being disposed over the work-area and being provided with means to maintain the shuttle substantially stationary during advancement of the web;

gripping means for an attachment for the liner and arranged to move said attachment into engagement with the web at a location where the attachment is to be secured to the liner;

a plastics bonder adapted to effect a bonding operation of the engaging surfaces of the web and the attachment;

a pair of separator boards provided at a closure station, one each side of the web and each projecting between the folded material defining the gusset panels, thereby separating the upper and lower gusset panels;

seam-welding apparatus disposed at the closure station to effect upper and lower weld seams across the width of the web thereby to join the upper and lower layers to the respective upper and lower gusset panels with the weld seams on each layer being in a generally V-shaped configuration thereby to form an end panel at a second end region of the liner; and a web-cutter to sever a length of web material drawn from the reel, so as at least partially to form the liner.

16. Apparatus as claimed in claim 15, wherein the side edge margins of the shuttle are defined by a pair of gusset boards adjustable transversely with respect to the plastics material web within which the shuttle is located.

17. Apparatus as claimed in claim 15, wherein a layer cutter is adapted to co-operate with the shuttle to cut an opening through the upper layer of the plastics material overlying the shuttle, prior to the bonding thereto of an attachment.

18. Apparatus as claimed in claim 15, wherein the shuttle is provided with at least one running roller or freely rotatable ball by means of which the shuttle is supported on the work-area, through at least the lower layer of the plastics material.

19. Apparatus as claimed in claim 15, wherein the shuttle and the work-area are provided with respective magnetic materials which inter-act to maintain the shuttle substantially stationary during advancement of the web.

20. Apparatus as claimed in claim 15 and for use with a web of folded-flat sheet plastics material having two opposed long edges, wherein the shuttle is provided with a laterally-extending arm which is secured to a fixed part of the apparatus, the arm extending out of the layers of the web at a long edge thereof and a seam bonder is arranged to unite the plastics material along said long edge downstream of the arm, to form a tube.

21. Apparatus as claimed in claim 15, wherein the gripping means includes a gripper for the attachment and means to move the gripper from a first position where the gripper picks up the attachment and a second position where the gripper engages a face of the attachment with the plastics material forming the liner.

22. Apparatus as claimed in claim 21, wherein the attachment is an access pipe for the liner, and at the first position the gripper locates within a length of access pipe, adjacent one end thereof, for moving the access pipe to engage the plastics material of the liner.

23. Apparatus as claimed in claim 15, wherein a jack is provided on the work-area for generally vertical movement, to co-operate with the shuttle during a cutting or bonding step.

* * * * *